US005127136A

United States Patent [19]

Magnus

[11] Patent Number: 5,127,136

[45] Date of Patent: Jul. 7, 1992

[54] BELT BUCKLE

[76] Inventor: Douglas Magnus, 905 Early St., Santa Fe, N. Mex. 87501

[21] Appl. No.: 743,683

[22] Filed: Aug. 12, 1991

[51] Int. Cl.[5] ..... A44B 11/22

[52] U.S. Cl. ..... 24/176; 24/177

[58] Field of Search ..... 24/176, 177, 198, 186

[56] References Cited

U.S. PATENT DOCUMENTS

| | | | |
|---|---|---|---|
| 414,407 | 11/1889 | Hartley et al. | 24/177 |
| 422,510 | 3/1890 | Echlin | 24/176 |
| 502,787 | 8/1893 | Swigart | 24/177 |
| 712,890 | 11/1902 | Zeller | 24/177 |
| 900,774 | 10/1908 | Pearl | 24/176 |
| 2,419,662 | 4/1947 | Sutton | 24/177 X |
| 2,783,516 | 3/1957 | Stern | 24/176 |
| 3,913,147 | 10/1975 | Ostrander | 24/177 X |
| 4,502,188 | 3/1985 | Kohli | 24/186 X |

*Primary Examiner*—James R. Brittain
*Attorney, Agent, or Firm*—Robert M. Wolters

[57] ABSTRACT

A buckle is provided for releasable cooperation with a belt. The buckle has an undersurface with a projection adjacent the rear edge thereof extending out from the undersurface and having a first window therein relatively adjacent the undersurface and a second window extending out from the first window away from said undersurface. One or more anchoring studs are provided on the undersurface forwardly of the window for receiving one or more holes in an end portion of the belt extending through the first window. The opposite end of the belt cooperates with a latching stud adjacent the front edge of the buckle, and this portion of the belt then projects over the anchoring stud and through the second window.

7 Claims, 1 Drawing Sheet

BELT BUCKLE

BACKGROUND OF THE INVENTION

Belts are commonly used both by men and by women. They are used functionally to support pants or other garments, and also ornamentally as a color item, and often with an ornamental buckle.

For various reasons, it may be desirable to change a buckle from one belt to another. For example, the buckle may be a very ornate one having intricate designs, or jewels incorporated therein, and it may be expensive due to incorporation of jewels, or due to being made from a semi-precious or precious metal. Thus, it may be desirable to use but a single belt buckle with a large number of belts.

Conversely, it may be desirable to have a single favorite belt usable with a plurality of different belt buckles.

Particularly from the standpoint of a retailer, it may be highly desirable to have belts and buckles separately available to allow a customer to choose one or more buckles that the customer may want, with one or more belts, to be matched at the customer's desire.

The prior art has not adequately provided for interchange of belts and buckles and selective joining thereof. Often buckles are permanently affixed to belts, and there can be no question of interchangability. There have been belts and buckles that are separable or available individually for subsequent joining, but they have generally either been difficult to separate and/or connect, or they have not been reliably connectable to one another.

OBJECTS AND SUMMARY OF THE PRESENT INVENTION

It is an object of the present invention to provide a belt buckle which is readily connected to and separated from the end of a belt.

It is a further object of the present invention to provide a discrete belt buckle which s readily assembled with a belt or disassembled therefrom without the necessity of manipulating any fasteners or the like, and yet which forms a secure connection when mounted on a belt.

Yet another object of the present invention is to provide a separable belt buckle in which the tongue or opposite end of the belt aids in securing the belt buckle to the rear end of the belt that is commonly connected with a buckle.

In carrying out the foregoing and other objects of the present invention I provide a belt buckle, which preferably is ornamental on the face thereof, and which has a pair of channels at the rear end of the buckle. The rear end of the belt is inserted through the channel closest to the body of the buckle. Prongs formed integrately on the back surface of the buckle are angled toward the front edge of the buckle, and pass through holes in the belt after it has been inserted through the foregoing channel, whereby to mount the buckle on the belt. The opposite or tongue end of the belt is secured by a rearwardly directed prong on the back face of the buckle body adjacent the front edge thereof. A hole in the belt fits over this prong, while the extending end of the belt tongue passes behind the rear end of the belt and through the second or outermost channel, whereby the tongue of the belt is held in proper position, and helps to hold the rear end of the belt in its installed position with buckle. THE DRAWINGS The present invention will best be understood with reference to the following detailed description when taken in connection with the accompanying drawings wherein:

DETAILED DESCRIPTION OF THE ILLUSTRATED EMBODIMENT

Figures 1, 2, 3, 4, 5, 6, 7, 8:
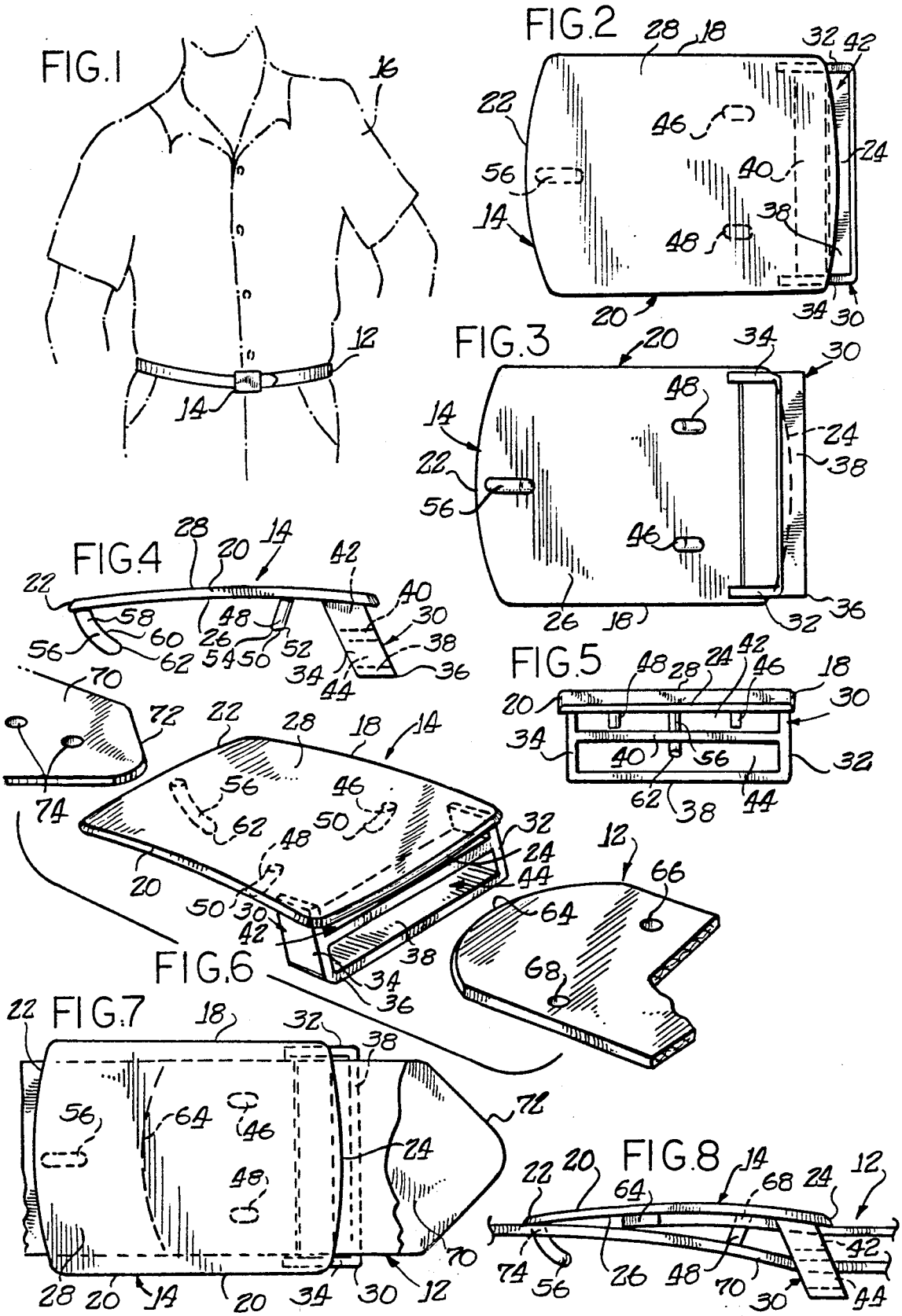
FIG. 1 is a front view of the buckle constructed in accordance with the present invention as mounted on a belt encircling the waist of a wearer.
FIG. 2 is a front view of the present buckle on an enlarged scale.
FIG. 3 is a rear or back side view of the belt buckle of FIG. 2.
FIG. 4 is a side view of the belt buckle.
FIG. 5 is a rear end or edge view of the belt buckle.
FIG. 6 is a perspective view generally from the front of the belt buckle showing the opposite ends of the belt as they are about to be assembled with the belt buckle.
FIG. 7 is a front view of the belt buckle as assembled and worn with the belt.
FIG. 8 is an edge view similar to FIG. 4, but showing the ends of the belt as assembled with the buckle.

In FIG. 1 a belt 12 having a buckle 14 constructed in accordance with the principles of the present invention is shown as encircling the waist of a person 16. The belt 12 may be made of leather or any other suitable material, while the buckle is preferably made of metal, but could be made of other materials such as resinous plastic or wood product, for example. The front surface of the belt buckle typically would be ornamental in nature, but is shown in the patent drawings as simply being plain. The ornamental front could be made by indentation or protrusion, or by setting of real or synthetic gemstones therein. Another possibly is that the initials of the wearer could be engraved in the front surface of the buckle.

Further details of the buckle and of the belt are shown in the remaining figures of the drawings.

The buckle 14 is shown as being generally rectangular in outline, having, as viewed from the front, straight upper and lower edges 18 and 20, respectively. The front or leading edge 22 of the buckle is shown as convex, or curved outwardly as is the trailing edge 24. However, it must be understood that this shape is strictly illustrative, and that other shapes could be used.

The illustrative belt buckle 14 is curved from end to end as best seen in FIG. 4, being concave on the surface 26 confronting the wearer, and convex 28 on the outer or upper surface away from the wearer. However, it is contemplated that other shapes could be used. In the illustrative example it will be seen that the buckle is straight across, being curved only from end to end.

The buckle is provided on the inner surface 26 adjacent the rear or trailing edge 28 thereof with a rearwardly projecting window structure 30. The window structure 30 comprises upper and lower side bars 32 and 34, respectively, which are secured to the under surface 26 slightly inwardly from the rear end 24, but projecting diagonally therefrom as best seen in FIG. 4 to an outer limit 36 that projects beyond the rear edge 24. A transverse bight 38 extends between the outer ends of the side bars 32 and 34, while a parallel intermediate bight 40 extends between the side bars 32 and 34 at an intermediate position. As is readily seen in the drawings, the side bars and the bights are elongated longitudinally of the buckle. These parts define a first window or channel 42 immediately adjacent the undersurface 26 of the buckle and a second window or channel 44 disposed further from the inner or undersurface 26. The window structure 30 preferably is comprised of integral parts, and it may be cast or otherwise formed integral with the buckle 14, or it may be a separate part which is welded or suitably secured to the rear or undersurface 26 of the buckle.

Placed slightly forwardly of the window structure are a pair of rearwardly projecting belt anchoring studs or prongs 46 and 48. These studs or prongs are disposed more or less diagonally so that the outer ends 50 thereof are located closer to the front edge 22 of the buckle than are the bases thereof secured to the undersurface 26. The outer ends 50 of these studs as best seen in FIG. 4 are somewhat pointed in a non-symmetric manner so that the trailing edge 52 is shallower that the leading edge 54. The studs are circular in cross section and are respectively spaced approximately half way between the longitudinal midline of the belt buckle and the respective upper and lower edges 18 and 20. The studs or prongs 46 and 48 may be cast or molded integrally with the main portion of the belt buckle 14, or they may be separate pieces, such as lengths of brass wire, welded or otherwise secured to the rear or undersurface 26 of the buckle. It further will be observed in FIG. 4 that the ends 50 of the studs or prongs 46 and 48 extend substantially the same distance from the rear surface 26 as does the surface of the intermediate bight 40 confronting the surface 26.

Finally, the buckle 14 is provided on the rear or undersurface 26 with a belt matching stud 56 adjacent the leading edge 22 of the buckle. The stud 56 is provided substantially on the longitudinal center line of the buckle. Like the studs 46 and 48, the stud 56 may be formed integrally with the major portion of the buckle 14, or it may be a separate part welded or otherwise suitably secured to the rear surface 26 of the buckle. The base end 58 adjacent the surface 26 is spaced in very slightly from the leading edge 22, and the stud 56 curves from end to end, being concave at 60 relatively toward the window structure 30. The stud 56 is circular in cross section, and the outer end 62 thereof is rounded. It will be observed that the outer end 62 extends further from the undersurface or rear surface 26 of the buckle than does the bight 40. The curvature of the stud 56 enhances the generally rearwardly angulation of the stud.

The width of the belt 12 is approximately the same dimension as the length of the bights 38 and 40, although it may be somewhat less, as the rear end thereof as seen best in FIGS. 6 and 7 is substantially curved at 54 being outwardly convex. A short distance in from the end 64 are holes 66 and 68 punched through the belt. These holes are positioned substantially midway between the longitudinal center line of the belt and the respective edges thereof and specifically are spaced exactly the same as the two studs 46 and 48.

The outer extremity of tongue 70 of the belt has a tapered or rounded nose 72, and one or more holes 74 are punched through the belt along the longitudinal center line thereof. These holes are of substantially the same diameter as the latching stud 56.

The thickness of the belt may be only slightly less than the minimum dimension of the windows 42 and 44, or it may h=substantially less as shown in FIGS. 6–8. The rear end 64 of the belt is inserted through the first window 42 and is moved forwardly along the undersurface of the buckle to permit the studs 46 and 48 to extend through the holes 66 and 68. The belt then may be wrapped about the waist of the wearer, and the tongue 70 of the belt is moved into the window 44 relatively from the front edge 22 of the buckle, with the stud 56 being inserted through an appropriate hole 74 depending on the relative length of the belt and the waistline of the wearer.

As will be seen particularly in FIG. 8 the window or channel 42 provides restraint to hold the rear end of the belt substantially against the undersurface 26 of the buckle so that the holes 68 remain firmly about the studs 48. This is enhanced by the position of the tongue 70 of the belt which underlies the rear end 64 of the belt, and helps to hold the rear end of the belt against the rear or undersurface 26. The tongue of the belt is itself preferably constrained by the window 44. The constraint offered by the window 44 to the tongue of the belt helps to hold the tongue on the latching stud 56 with the hole 74 surrounding the stud. It will be understood that under some circumstances it might be desirable or necessary to provide holes 74 closer to the tapered end 72 of the belt, but in that instance the tongue might not extend completely through the window 44, and securement of the buckle to the belt would not be as great, although the curvature of the latching 56 helps to wedge the belt toward the base end of this stud.

It will now be seen that the buckle 42 is separate from the belt 12, and may be secured to any of a plurality of belts with may be of different color or different length, or otherwide distinguished from one another, and that a plurality of like buckles could be selectively secured to a single belt. Securement of the buckle to the belt, and latching of the belt to the buckle at the tongue thereof is readily accomplished as just described. Separation of the belt from the buckle is the reverse of the assembly.

The specific example of the invention as herein shown and described is for illustrative purposes. Various changes in structure will no doubt occur to those skilled in the art, and will be understood as forming a part of the present invention insofar as they fall within the spirit and scope of the appended claims.

The invention is claimed as follows:

1. A buckle adapted for use with a belt having a first end portion and a second end portion, said buckle comprising a body having a front edge and a rear edge, a pair of longitudinal edges spaced from one another and extending between said front edge and said rear edge, and an undersurface, a projection extending outwardly from said undersurface and disposed relatively adjacent said rear edge, said projection having a first window adjacent said undersurface and a second window spaced from said undersurface, a pair of sidebars extending from said longitudinal edges substantially perpendicular to said undersurface and having outer ends, an outer cross member extending between said outer ends and substantially parallel to said undersurface, and an intermediate cross member extending between said sidebars intermediate said outer cross member and said undersurface, said undersurface, said side bars and said intermediate cross member defining said first window and said outer cross member, said intermediate cross member and said side bars defining said second window, both of said cross members and both of said side bars being continuous, and both of said windows being unobstructed in a dimension substantially parallel to said body longitudinal edges, at least one anchoring stud relatively adjacent said projection extending outwardly from said undersurface, and a latching stud relatively adjacent said front edge and extending outwardly from said undersurface, said first window being adapted to receive a belt first end portion extending through said first window in both directions longitudinally of said body with a hole in said belt receiving said anchoring stud, and said second window being adapted to receive a belt second end portion extending through said second window in both directions longitudinally of said body with a hole in said belt receiving said latching stud.

2. A buckle as set forth in claim 1 wherein said first window has a predetermined height away from said undersurface, and wherein said anchoring stud extends from said undersurface a distance substantially equal to said predetermined height.

3. A buckle as set forth in claim 2 wherein said anchoring stud is angled away from said rear edge.

4. A buckle as set forth in claim 2 wherein said second window has a predetermined height outwardly from said first window, and wherein said latching stud extends from said undersurface a distance substantially at least as great as said first window height, and substantially no more than the total of said first and second window heights.

5. A buckle as set forth in claim 1 wherein said latching stud is angled away from said front edge, and is continuously curved and is concave toward said rear edge.

6. The combination comprising a buckle as set forth in claim 1, and further including a belt having a first end portion with at least one hole therein and a second end portion with at least one hole therein, said first end portion of said belt extending through said first window relatively from the rear edge toward the front edge of said buckle, and the hole in said first end portion receiving said anchoring stud, said second end portion of said belt extending through said second window with the hole therein receiving said latching stud, and said second end portion between said latching stud and said second window overlying a portion of said belt first end portion and said anchoring stud.

7. The combination as set forth in claim 6 wherein said anchor stud is angled away from said rear edge, said latching stud is angled away from said front edge, said first window extending outwardly from said undersurface a first predetermined distance, said second window extending outwardly from said first window a second predetermined distance, said anchoring stud extending out from said undersurface a distance substantially equal to said first pretermined distance, and said latching stud extending out from said undersurface a distance at least substantially as great as said first window predetermined distance, but less than substantially the sum of said first window predetermined distance and said second window predetermined distance.

* * * * *